US006233832B1

(12) United States Patent
Berns

(10) Patent No.: US 6,233,832 B1
(45) Date of Patent: May 22, 2001

(54) RAZOR KNIFE WITH RETRACTABLE AND LATCHABLE BLADE GUARD

(75) Inventor: Harald Berns, Wuppertal (DE)

(73) Assignee: Martor-Argentax E.H. Beermann KG, Solingen (DE)

( * ) Notice: Subject to any disclaimer, the term of this patent is extended or adjusted under 35 U.S.C. 154(b) by 0 days.

(21) Appl. No.: 09/330,300

(22) Filed: Jun. 11, 1999

(30) Foreign Application Priority Data

Jun. 11, 1998 (DE) ..... 198 25 941
May 21, 1999 (DE) ..... 199 23 181

(51) Int. Cl.[7] ..... B26B 1/08
(52) U.S. Cl. ..... 30/162; 30/286; 30/293
(58) Field of Search ..... 30/2, 162, 286, 30/293, 294, 151

(56) References Cited

U.S. PATENT DOCUMENTS

| | | | | |
|---|---|---|---|---|
| 142,942 | | 7/1873 | Ratelle . | |
| 2,743,523 | | 5/1956 | Honey | 30/286 |
| 3,943,627 | * | 3/1976 | Stanley, Jr. | 30/151 |
| 4,086,698 | | 5/1978 | Sparks | 30/2 |
| 4,393,587 | | 7/1983 | Kloosterman | 30/162 |
| 4,523,379 | * | 6/1985 | Osterhout et al. | 30/151 |
| 4,569,133 | | 2/1986 | Schmidt | 30/293 |
| 4,757,612 | * | 7/1988 | Peyrot | 30/151 |
| 5,325,594 | | 7/1994 | Szafranski | 30/294 |
| 5,890,290 | * | 4/1999 | Davis | 30/2 |

FOREIGN PATENT DOCUMENTS

| | | | | |
|---|---|---|---|---|
| 1 121 972 | | 8/1960 | (DE) . | |
| 26 23 490 | | 12/1977 | (DE) . | |
| 81 19 855 | | 9/1981 | (DE) . | |
| 31 16 354 | | 11/1982 | (DE) . | |
| 34 33 286 | | 4/1985 | (DE) . | |
| 3400850 | * | 7/1985 | (DE) | 30/151 |
| 35 40 026 | | 5/1988 | (DE) . | |
| 89 12 929 | | 12/1989 | (DE) . | |

OTHER PUBLICATIONS

Messer Gerhard Alarich Ern. Solingen–Wald, E 19792,PA 284071, 5 pages, Aug. 1964.

* cited by examiner

*Primary Examiner*—Rinaldi I. Rada
(74) *Attorney, Agent, or Firm*—Herbert Dubno; Andrew Wilford

(57) ABSTRACT

A knife has an elongated handle having a front end, a longitudinally extending flat blade secured in the handle, projecting from the front end, and having a transverse front edge and a longitudinally extending side cutting edge meeting at a point, and a blade guard longitudinally displaceable on the handle between an outer extended position projecting longitudinally outward of the point and a retracted position exposing the point. A guard spring braced between the guard and the handle urges the guard into the extended position. A button is transversely displaceable on the handle between an actuated and an unactuated position and interengageable formations on the button and on the guard prevent movement of the guard from the extended into the retracted position in the unactuated position of the button.

28 Claims, 9 Drawing Sheets

RAZOR KNIFE WITH RETRACTABLE AND LATCHABLE BLADE GUARD

FIELD OF THE INVENTION

The present invention relates to a razor or utility knife. More particularly this invention concerns such a knife with a retractable blade guard.

BACKGROUND OF THE INVENTION

A standard utility knife has an elongated handle having an outer end and a longitudinally extending flat blade secured in the handle and projecting outwardly from the outer end. The blade has a transverse outer edge and a longitudinally extending side or front cutting edge meeting at a point. Such a knife is useful for opening packages, including cartons and bags, and is typically carried in the pocket or tool belt of the person using it.

In order to protect the user from injury by the cutting edge and point it is known from German patent 3,116,354 and U.S. Pat. No. 4,086,698 to form the handle with a longitudinally outwardly open and longitudinally extending guide slightly offset laterally from the cutting edge of the blade. A longitudinally extending pin has an outer end carrying a bumper or shield and is longitudinally displaceable in the guide between an extended positions with the outer end lying longitudinally outward of the point and a retracted position with the outer end longitudinally inward of the point. A spring is braced between the pin and the handle and urges the pin into the extended position.

The problem with this system is that it is relatively easy to accidentally push in the guard. Thus if the knife is in a pocket and the user reaches in to grab it, the knife or guard can be pushed to retract the guard and allow the blade to come into direct contact with the user or the user's clothing.

U.S. Pat. No. 142,942 describes a similar knife for use by a cobbler. A spring-loaded mechanism is provided in the handle to set the projection of the blade so as to limit the depth of cut, but it does not provide any protection against injury from the blade. The blade can be retracted into the handle or ejected from it by special maneuvers.

Another knife is known from German 3,433,286 which has a U-shaped guard for the blade. This guard, as in German 3,116,354, is spring loaded so it can be pushed back in by careless handling. Thus it provides little real safety for the user of the knife.

In German 3,540,026 there is a pivotal blade guard of elastic material. The guard can be locked in position by a relatively complex maneuver so that it is likely never to be locked, thereby affording little protection to the user.

OBJECTS OF THE INVENTION

It is therefore an object of the present invention to provide an improved utility knife with a retractable blade guard.

Another object is the provision of such an improved utility knife with a retractable blade guard which overcomes the above-given disadvantages, that is which allows the guard to be latched and unlatched relatively easily.

SUMMARY OF THE INVENTION

A knife has according to the invention an elongated handle having a front end, a longitudinally extending flat blade secured in the handle, projecting from the front end, and having a transverse front edge and a longitudinally extending side cutting edge meeting at a point, and a blade guard longitudinally displaceable on the handle between an outer extended position projecting longitudinally outward of the point and a retracted position exposing the point. A guard spring braced between the guard and the handle urges the guard into the extended position. A button is transversely displaceable on the handle between an actuated and an unactuated position and interengageable formations on the button and on the guard prevent movement of the guard from the extended into the retracted position in the unactuated position of the button.

Thus unless the button is actuated, the guard is locked in the outer position. The button can be built according to the invention as a bar extending along a front edge of the knife handle, so that it is automatically depressed and actuated when the knife is gripped in a manner to be used. Simple pressure on the guard will not, however, cause it to retract so that the knife can even be dropped on its tip without danger.

According to the invention the handle is formed with a longitudinally forwardly open and longitudinally extending guide slidably receiving the guard. The guard has an inner end carrying a pawl forming one of the formations and movable by the button between an engaged position of the formations and a disengaged position of the formations. This pawl is movable on the support and the formations of the pawl and handle are directed longitudinally and the pawl is pivotal on the support about a transverse pawl axis. More particularly the pawl has an arm extending longitudinally forward from the axis and formed with the one formation.

The system can be set up as described above so that so long as the button is actuated the guard is free to move back and forth between the extended and retracted positions. To this end the formations extend transversely and the button has a transversely directed surface engageable with the pawl. In addition the button is formed with a longitudinally open notch having a flank forming the one formation and the arm has an end engageable in the notch. A pawl spring braced between the pawl and the handle urges the pawl into a position with the formations longitudinally engageable with each other. A button spring urges the button into the unactuated position. In this system the button is formed of one piece with the notch.

In another system of this invention actuation of the button allows the guard to move into the retracted position, but if the guard moves back into the extended position it locks in place and can only move inward again if the button is released and reactuated. In this system a rocker forming the notch and movable longitudinally on the button has adjacent the notch a surface engageable longitudinally with the pawl in the actuated position of the button on movement of the guard from the retracted to the extended position. A rocker spring urges the rocker toward the pawl and is weaker than the guard spring. Thus the guard spring can overcome the force of the pawl spring for the desired override effect.

The rocker in this embodiment is pivotal on the button, the arm has an outer end engageable in the notch and with the surface of the rocker, and the one formation is between the outer arm end and the transverse pawl axis. The rocker spring is braced longitudinally between the rocker and the button and the guide forms the other formation.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
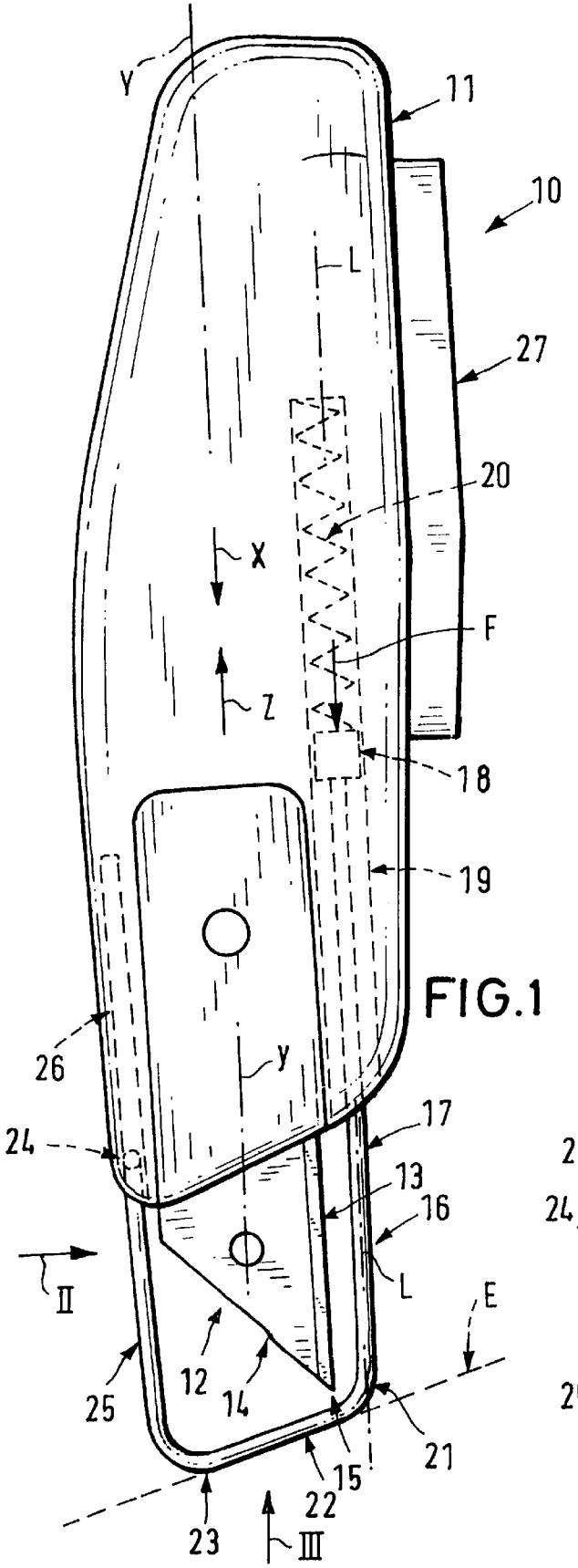
FIGS. 1 and 1A are side views of a knife according to the invention with the blade guard in the extended and retracted positions, respectively.
Figure 2:
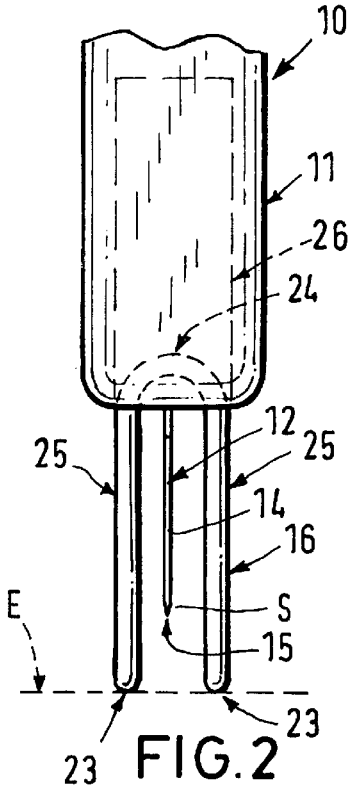
FIGS. 2 and 3 are rear-side and front-end views taken in the direction of respective arrows II and III of FIG. 1.
Figure 3:
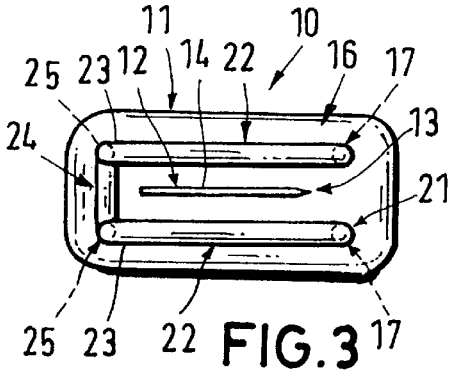
Figure 1A:
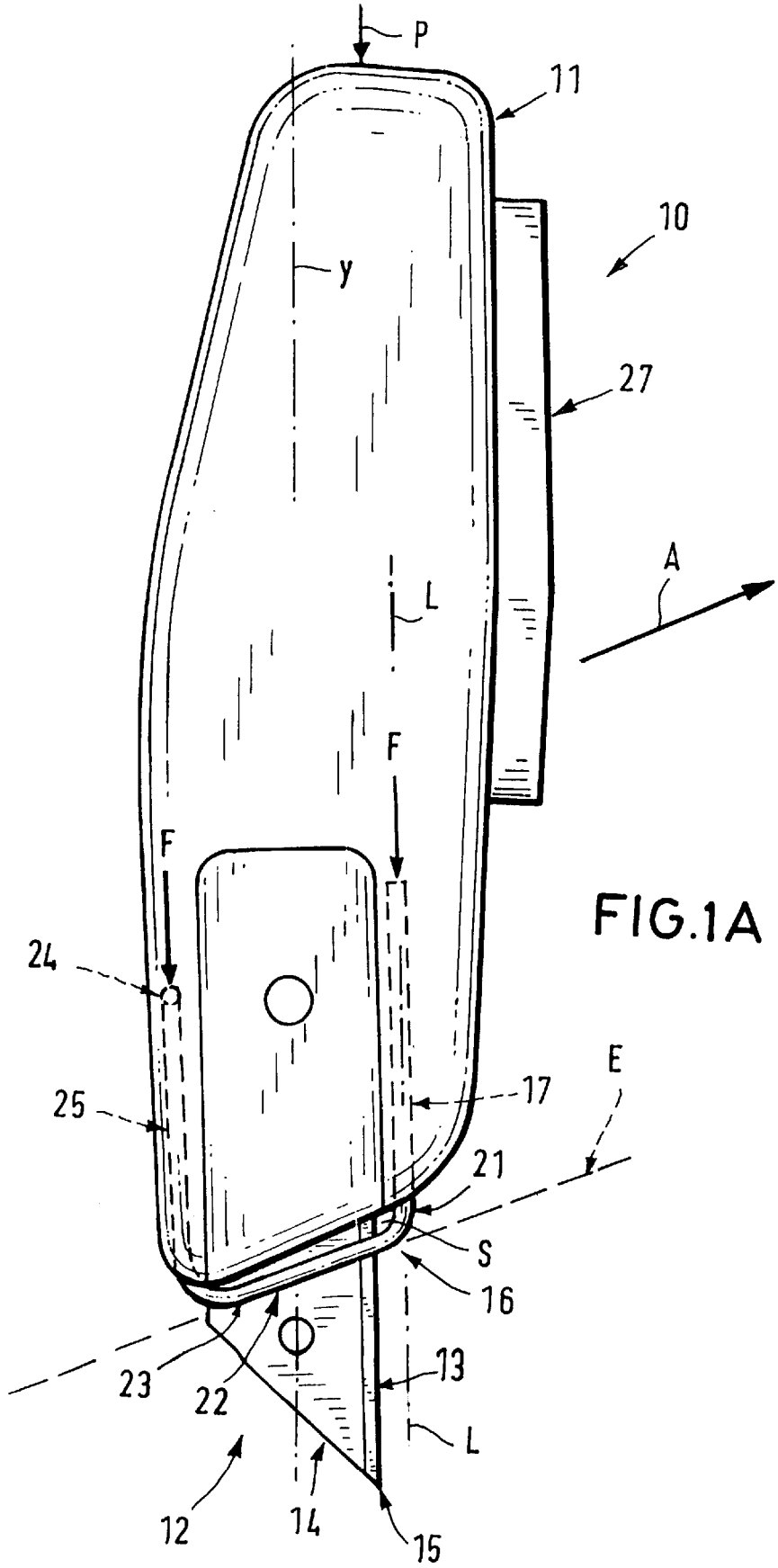

As seen in FIGS. 1, 1A, 2, and 3, a bag-opening knife 10 according to the invention has an elongated handle 11 centered on a longitudinal axis y and holding a standard trapezoidal razor blade 12 having a longitudinal side or front cutting edge 13 and an outer end edge 14 extending at a 45° angle thereto to form a point 15 therewith. A guard 16 is formed as two cylindrical and straight parts or pins 17 centered on respective axes L parallel to the axis y and equidistantly symmetrically flanking a plane of the blade 12 but at a slight spacing laterally from the side cutting edge 13 thereof. Inner ends 18 of the pins 17 are formed as pistons slidable in respective forwardly open guide bores 19 formed in the handle 11. Respective springs 20 braced in the guide bores 19 between the inner ends 18 and the floors of these bores 19 force the pins 17 longitudinally outward with a force F in an outward direction x. These springs 20 can be compressed on movement of the pins 17 backward in an inward retracting direction z.

The pins 17 are connected at elbows at their outer ends 21 to respective straight end sections 22 extending at an acute angle to the axes y and L and having rear ends 23. The rear ends 23 of the outer sections 22 are in turn extended back as guide pins 25 that fit in a guide slot 26 running along a back-side edge of the blade 12 in the handle body 11 and the inner ends of these guide pins 25, which are parallel to the pins 17, are joined together by a bight 24 extending perpendicular to the plane of the blade 12. Thus the guard 16, which is formed by a single piece of wire and moves longitudinally as a unit, completely surrounds the blade 12.

A transversely depressible and longitudinally extending finger grip or button 27 can actuate an unillustrated stop mechanism to block inward movement of at least one of the rear pin ends 18. Thus only when the spring button 27 is depressed can the pins 17 move inward past the mechanism, but even if the button 27 is held down, once the force pushing the guard 16 inward is released, it will slide out past the mechanism to reset itself in the extended position. As described below in more detail, in the arrangement of FIGS. 4 to 6 so long as the button 27 is depressed the guard 16 can be pushed back in, but in the arrangement of FIGS. 7 to 10 the button 27 will have to be actuated again to allow the guard 16 to retract again.

FIG. 1 shows the knife 10 with the guard 16 in the extended position in which its parts or pins 17 extend along and adjacent the cutting edge 13 and its outer sections 22 lie longitudinally outward of the front edge 14 of the blade 12. In this position the dangerous cutting edge 13 and the point 15 are recessed inward of the guard 16. The end sections 23 form a space S in which the blade 12 normally is protected. When the knife 10 is pressed in direction P (FIG. 1A) into something that is to be cut, as for instance a bag, the two sections 22 first come to rest on it. In the case of a bag these section 22 pull the material of the bag taut between themselves on a plane E as the knife 10 is pressed into the bag until the spring force F is overcome and the guard 16 starts to retract backward in direction z. The point 15 will therefore pierce easily through the taut region of bag between the sections 22 as the guard moves into the retracted position of FIG. 1A, whereupon movement of the entire knife 10 in the forward direction of arrow A will slit the bag open neatly. The guard therefore not only serves to protect the user from the blade 12 when the knife 10 is not in use, but it also facilitates the operation of the knife.

Figure 4:
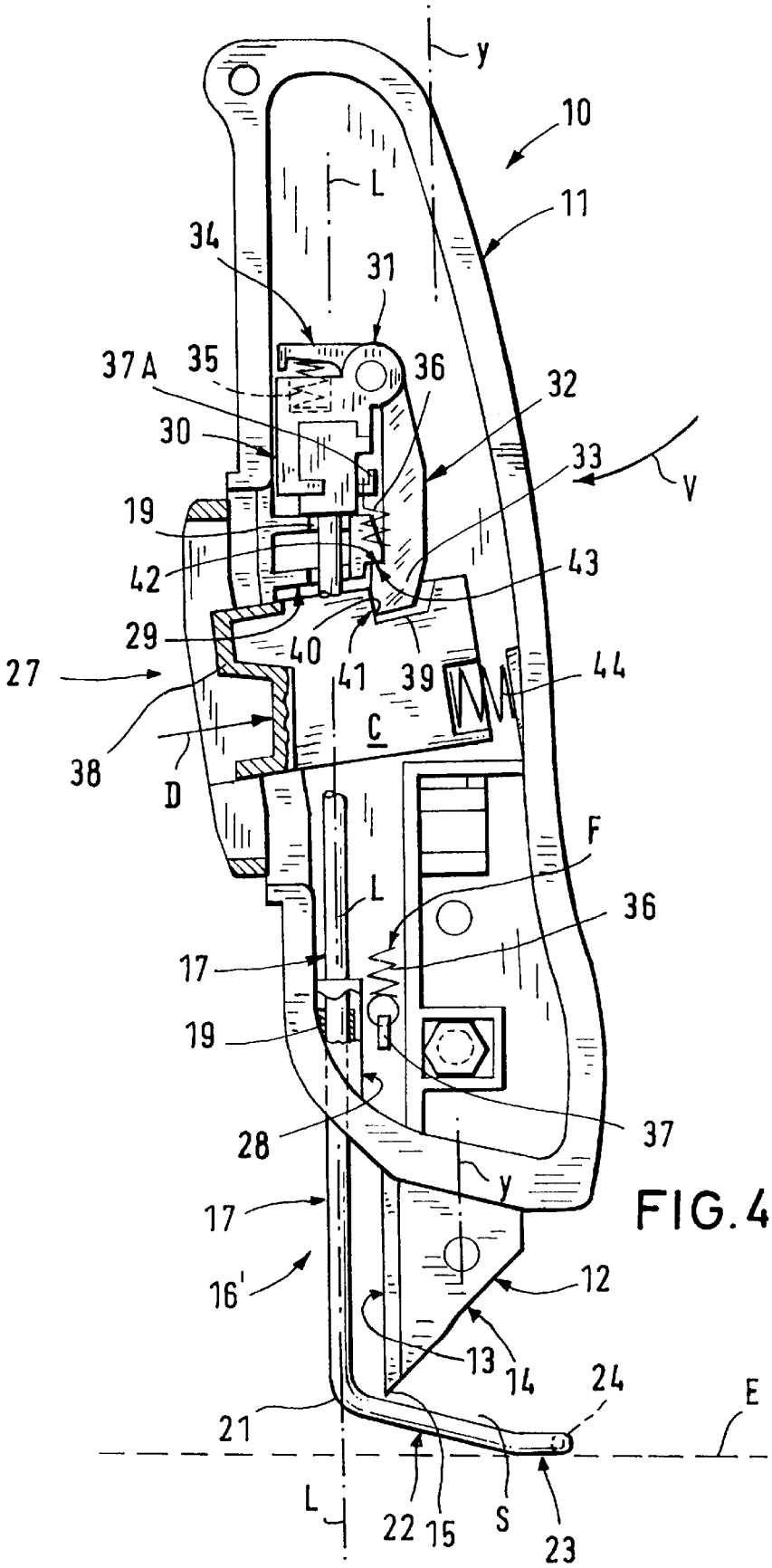
FIGS. 4 to 6 are longitudinal sections through another knife according to the invention in various positions.
Figure 5:
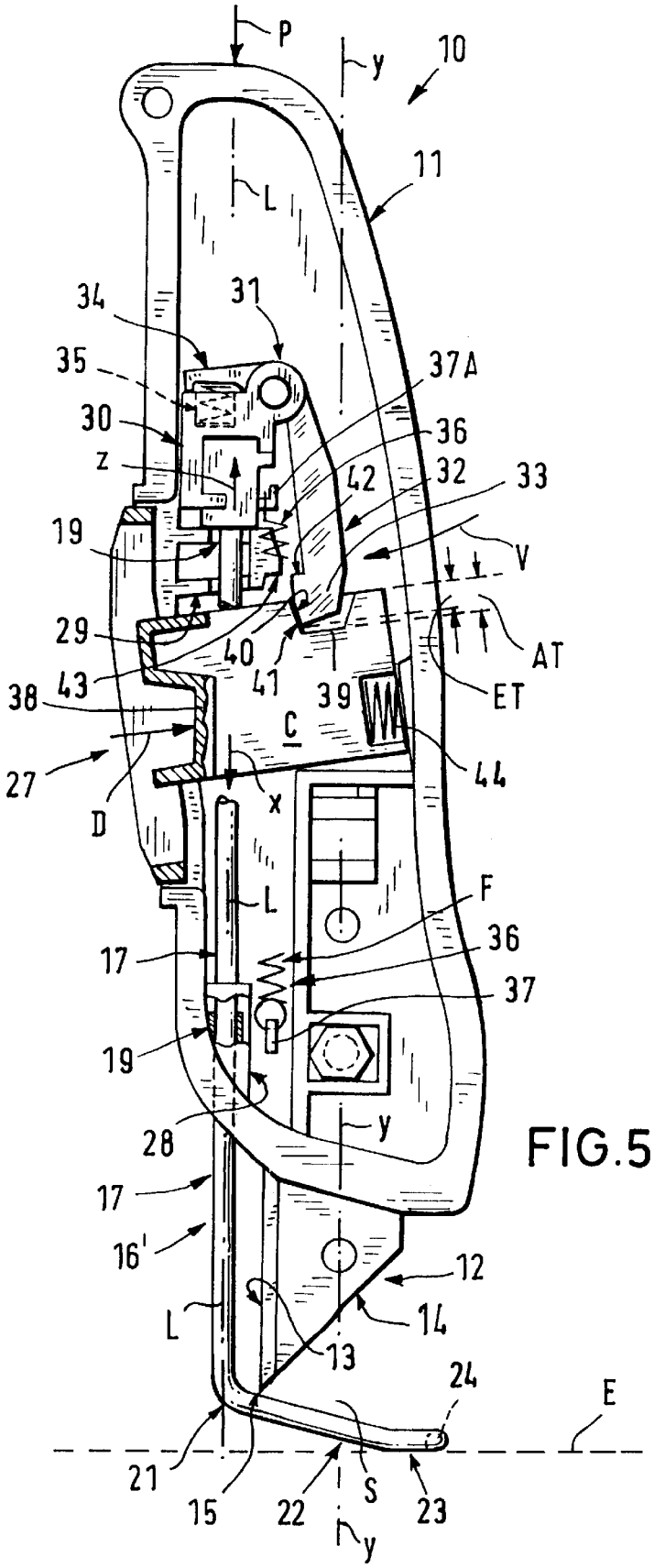
Figure 6:
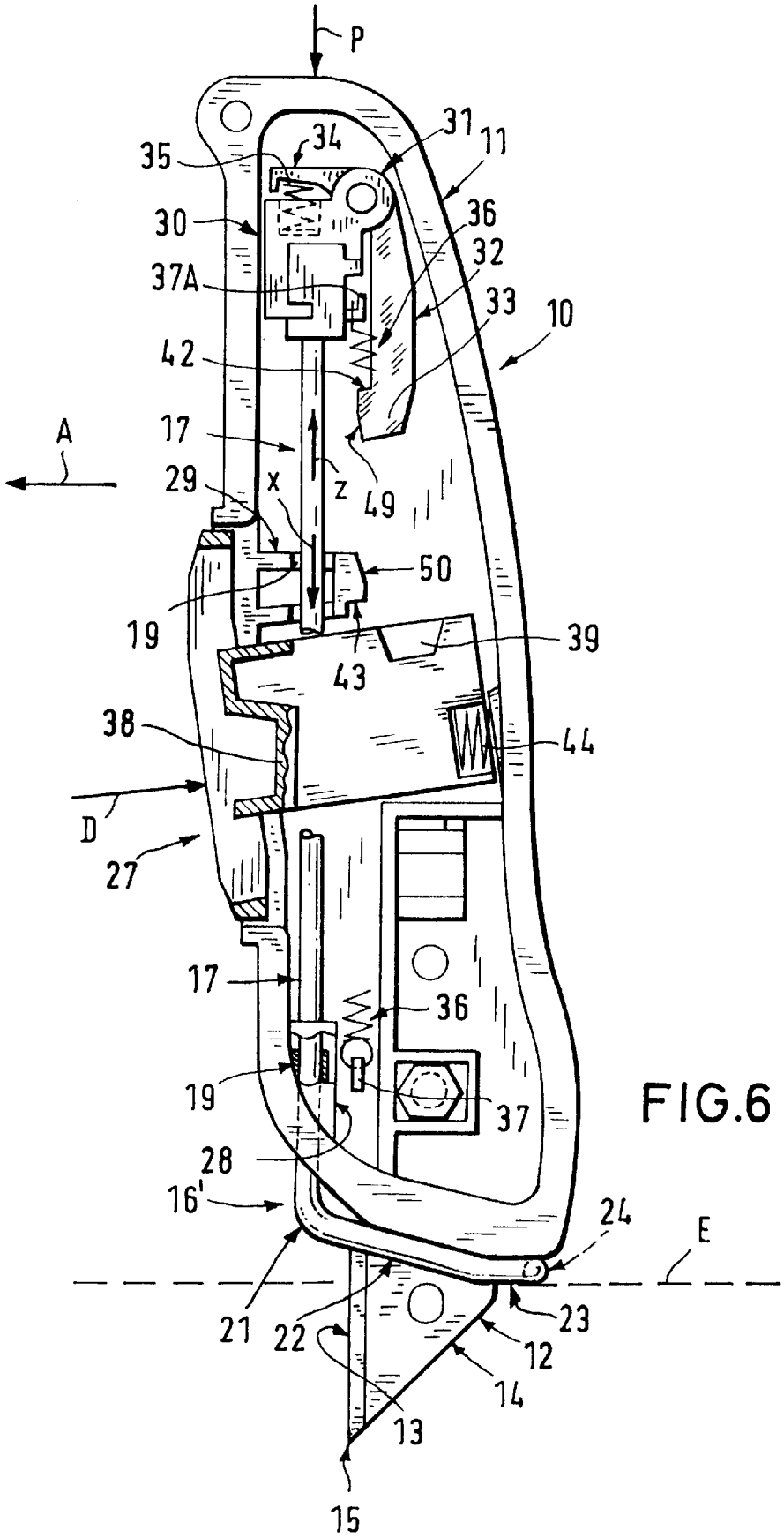

The knife 10 of FIGS. 4 to 6 is similar to that of FIGS. 1 to 4 with identical reference numerals and letters being used for functionally identical structure. Here the guide pins 25 and guide 26 are eliminated and the bight portion 24 connects the ends 23 of the outer sections 22 directly for a somewhat simpler bow-shaped guide 16'. The guide pins 17 slide in guide blocks 28 and 29 and have inner ends both seated in a support block 30. The compression springs 20 are replaced by a tension spring 36 (shown in two parts for clarity of view) having a front end hooked at 37 on the handle 11 and a rear end hooked at an eye 37A on the support 30. An adjustable stop can be provided on the handle 11 to limit the inward travel of the guard 16' to control the depth of cut.

This support 30 carries a two-arm L-shaped pawl or lever 32 pivoted about a transverse axis at 31 on the support 30 and having a forwardly extending latching arm 33 and a transversely extending actuating arm 34 urged in a direction V by a compression spring 35 braced against the support 30. The button 27 has an inner extension 38 formed with a laterally open notch 39 into which the end of the arm 33 can engage, with a face 40 of the notch 39 engageable with a face 41 of the arm 33. In addition an outwardly directed shoulder or edge 43 of the inner block 29 can catch on an inwardly directed shoulder or edge 42 of the arm 33 to arrest the support 30 and the guard 16'. A spring 44 urges the button 27 forward, against a rearward direction D it is pressed when actuated. The notch 39 has a depth AT which is somewhat greater than the distance ET that the arm 33 projects into it in the extended position of the guard 16'.

FIG. 4 shows the parts with the guard 16' extended and the button 27 unactuated. In this position the edges 42 and 43 engage each other so an inward push on the guard 16' will not move it, as the support 30 is coupled by the pawl 32 to the fixed shoulder 42 of the handle 11.

In FIG. 5 the system is shown with the button 27 actuated so that the pawl 32 is pivoted to bring the edges 42 and 43 out of line with each other. An inward push on the guard 16' as illustrated in FIG. 6 will therefore push this guard 16' inward. If the inward force on the guard 16' is released, the guard and support 30 will move outward in direction x and a camming edge 50 at a front edge of the block 29 will engage a surface 49 of the arm 33 and cam out the arm 33 so it fits into the notch 39 , but the edges 42 and 43 will not catch on each other so that the guard 16' can be pushed in again without having to reactuate the button 27.

In the arrangement of FIGS. 7 to 10, where once again previously used references are employed for functionally identical structure, the button 27 carries a rocker 46 pivotal about an axis 47 and urged inward by a spring 45. This rocker 46 has a projection 48 forming the notch 39 and surface 40.

Figure 7:
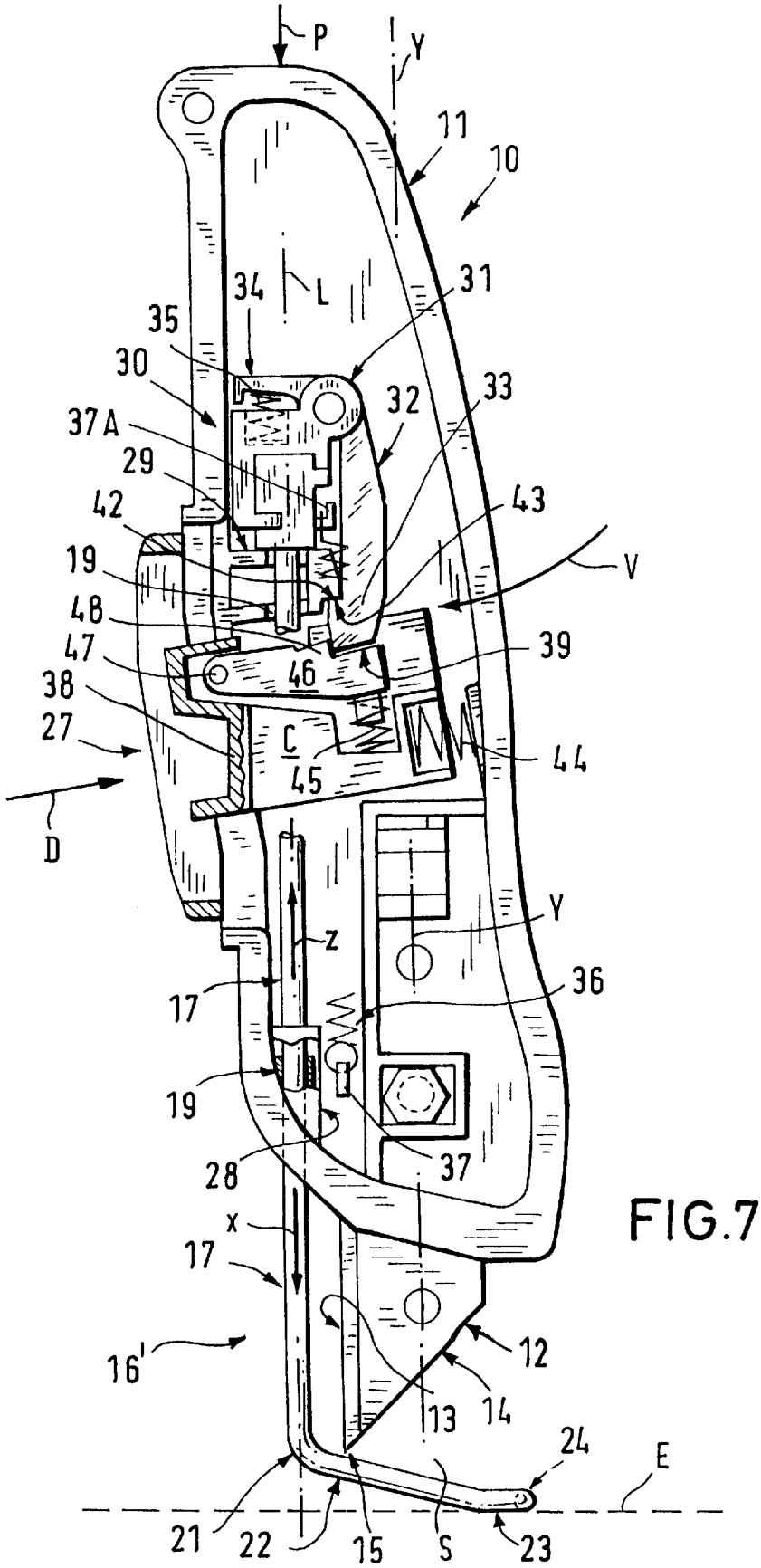
FIGS. 7 through 10 are longitudinal sections through yet another knife in accordance with the invention in various positions.
Figure 8:
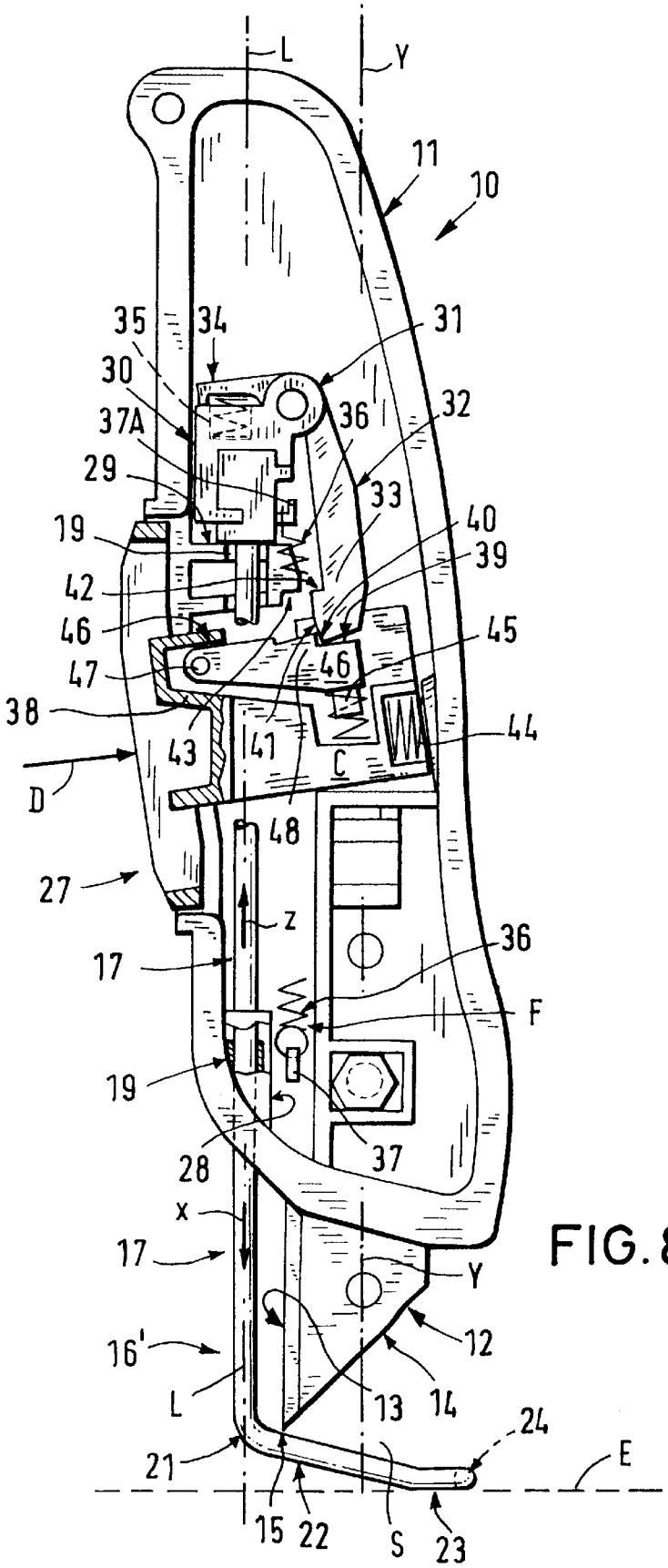
Figure 9:
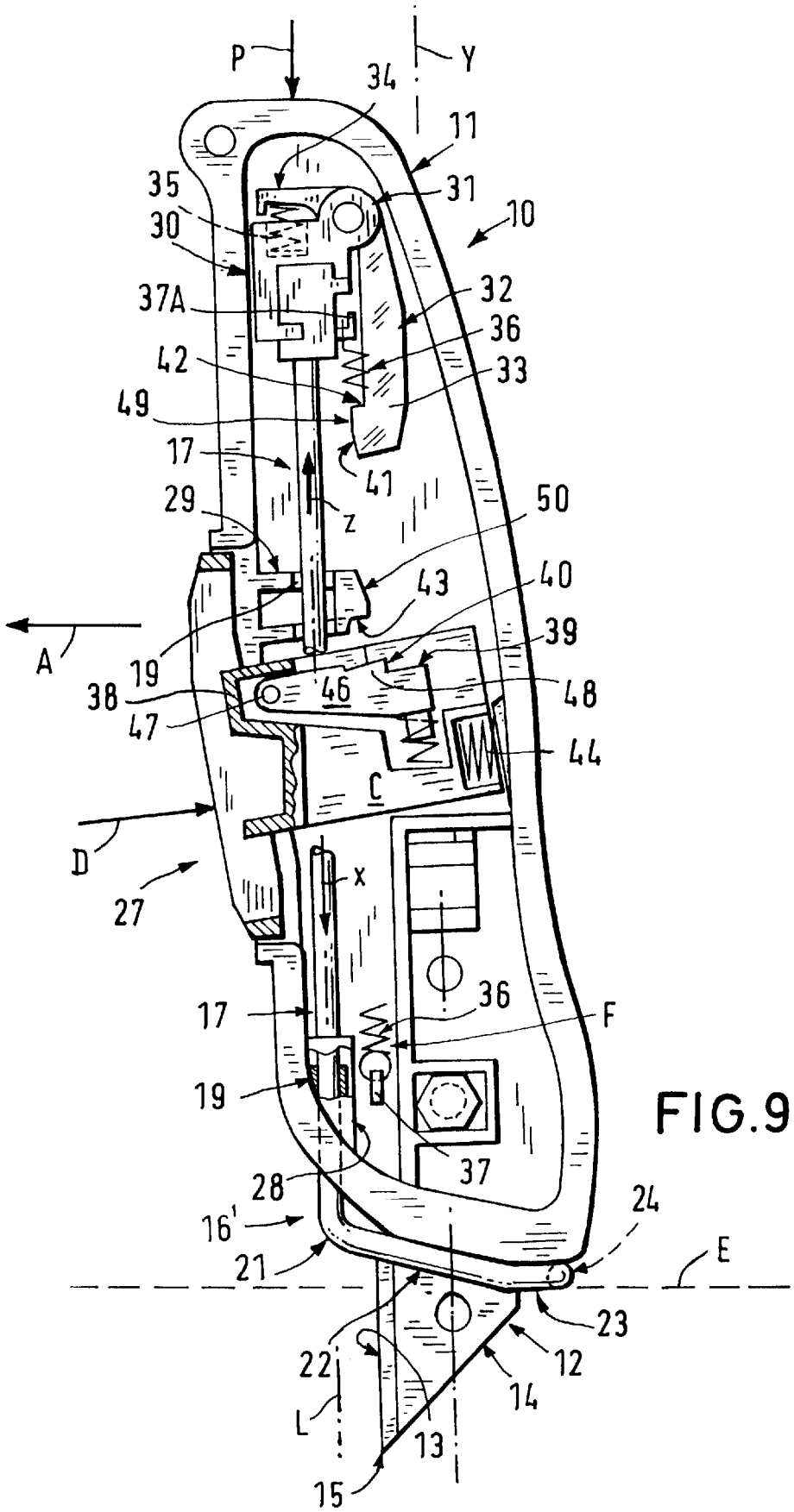

FIGS. 7, 8, and 9 correspond to the positions of FIGS. 4, 5, and 6. In FIG. 7 the button 27 is not actuated so the guard 16' is positively locked and held in the extended position. In FIG. 8 the button 27 is actuated so the guard 16' is free to move inward, and in FIG. 9 the guard 16' is shown moved inward with the button 27 actuated.

Figure 10:
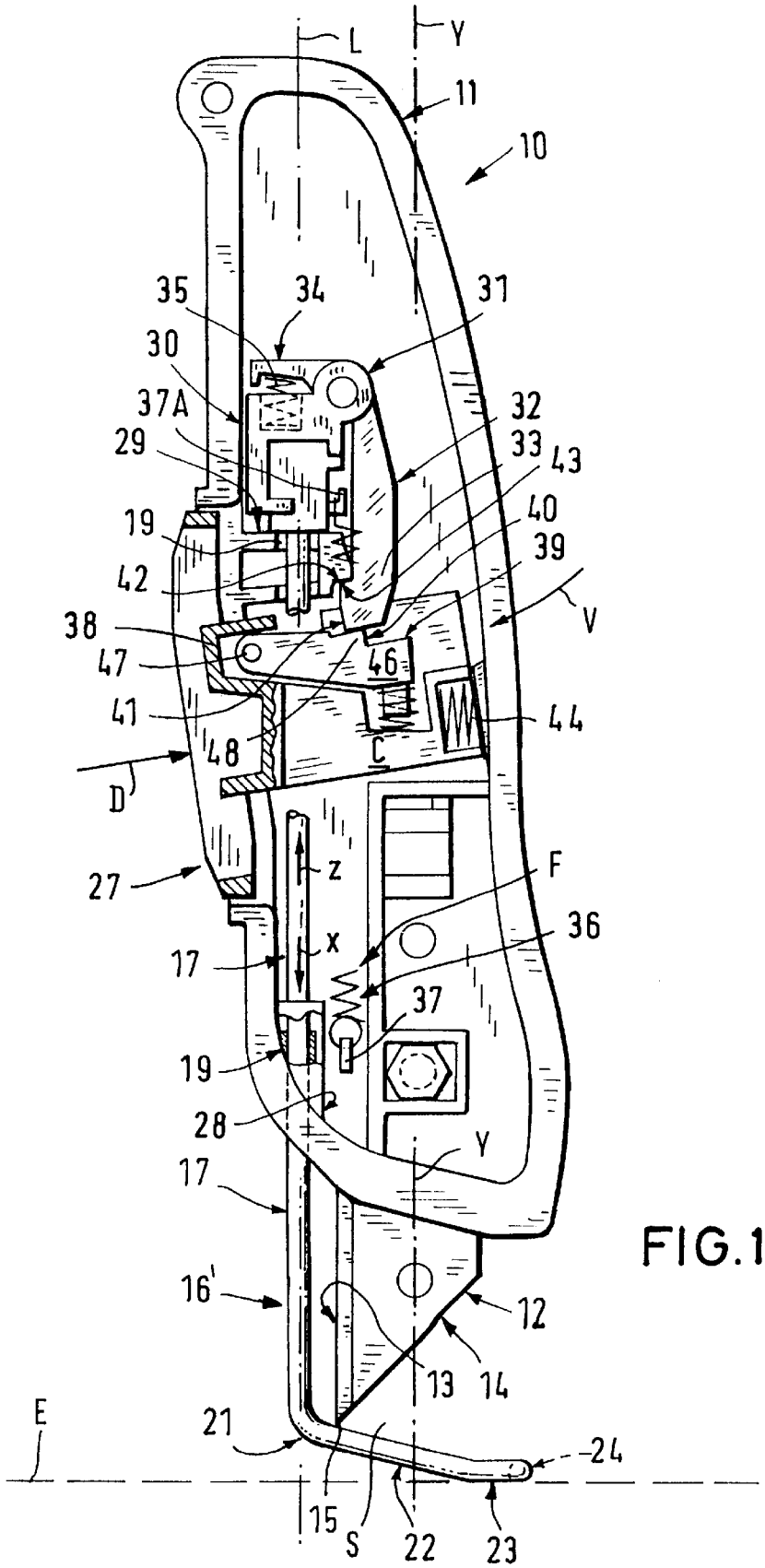

FIG. 10 shows, however, that if the force in direction z against the guard 16' is relaxed while the button 27 is actuated, the guard 16' will move outward but, instead of the arm 33 of the pawl 32 seating in the notch 39, the arm 33 will butt against the side of the rocker 46 and push it down against the force of its spring 45 and the surfaces 42 and 43 will catch on each other to lock this guard 16' in the extended position. Thus even though the button 27 is actuated, the guard 16' cannot move inward. Only when the button 27 is released and reactuated will the edge 40 of the notch 39 engage the edge 41 of the arm 33 to disengaged the edges 42 and 43 and allow the guard 16' to move back inward.

I claim:

1. A knife comprising:

an elongated handle having a front end and formed with a longitudinally forwardly open and longitudinally extending guide;

a longitudinally extending flat blade secured in the handle and projecting from the front end, the blade having a transverse front edge and a longitudinally extending side cutting edge meeting at a point;

a blade guard longitudinally displaceable on the handle in the guide thereof between an outer extended position projecting longitudinally outward of the point and a retracted position exposing the point;

a pawl carried on the guard;

a guard spring braced between the guard and the handle and urging the guard into the extended position; and means including a button transversely displaceable on the handle between an actuated position and an unactuated position and having a formation engageable with the pawl of the guard for moving the pawl into engagement with the formation and preventing movement of the guard from the extended position into the retracted position in the unactuated position of the button.

2. The knife defined in claim 1 wherein the formation is directed longitudinally and the pawl is pivotal on the guard about a transverse pawl axis.

3. The knife defined in claim 2 wherein the pawl has an arm extending longitudinally forward from the axis and engageable with the formation, the formation extending transversely.

4. The knife defined in claim 3 wherein the button is formed with a longitudinally open notch having a flank forming the formation, the arm having an end engageable in the notch.

5. The knife defined in claim 4, further comprising a pawl spring braced between the pawl and the handle and urging the pawl into a position longitudinally engageable with the formation.

6. The knife defined in claim 5, further comprising a button spring urging the button into the unactuated position.

7. The knife defined in claim 4 wherein the button is formed of one piece with the notch.

8. The knife defined in claim 4, further comprising a rocker forming the notch, movable longitudinally on the button, and having adjacent the notch a surface engageable longitudinally with the pawl in the actuated position of the button on movement of the guard from the retracted to the extended position; and a rocker spring urging the rocker toward the pawl and weaker than the guard spring.

9. The knife defined in claim 8 wherein the rocker is pivotal on the button.

10. The knife defined in claim 8 wherein the arm has an outer end engageable in the notch and with the surface of the rocker and the formation is between the arm outer end and the transverse pawl axis.

11. The knife defined in claim 8 wherein the rocker spring is braced longitudinally between the rocker and the button.

12. The knife defined in claim 2 wherein the button has a transversely directed surface engageable with the pawl.

13. A knife comprising:

an elongated handle having a front end and formed with a longitudinally forwardly open and longitudinally extending guide a longitudinally extending flat blade defining a blade plane, secured in the handle, projecting from the front end, and having a transverse front edge and a longitudinally extending side cutting edge meeting at a point;

a blade guard having a pair of parts spacedly flanking the blade plane, slidably displaceable in the guide on the handle between an outer extended position projecting longitudinally outward of the point and a retracted position exposing the point, and having an inner end carrying a pawl, the longitudinally extending side blade edge being laterally exposed but recessed between the guard parts;

a guard spring braced between the guard and the handle and urging the parts of the guard jointly into the extended position;

a button transversely displaceable on the handle between an actuated position and an unactuated position; and means including a formation on the button and engageable with the pawl in an engaged position of the pawl and formation for preventing movement of the guard from the extended position into the retracted position in the unactuated position of the button.

14. The knife defined in claim 13 wherein the pawl is movable on the handle.

15. The knife defined in claim 14 wherein the formations of the guard and of the button are directed longitudinally and the pawl is pivotal on the handle about a transverse pawl axis.

16. The knife defined in claim 15 wherein the button has a transversely directed surface engageable with the pawl.

17. The knife defined in claim 15 wherein the pawl has an arm extending longitudinally forward from the axis and formed with the one formation, the formations extending transversely.

18. The knife defined in claim 17 wherein the button is formed with a longitudinally open notch having a flank forming the one formation, the arm having an end engageable in the notch.

19. The knife defined in claim 18, further comprising a pawl spring braced between the pawl and the handle and urging the pawl into a position with the formations longitudinally engageable with each other.

20. The knife defined in claim 19, further comprising a button spring urging the button into the unactuated position.

21. The knife defined in claim 18 wherein the button is formed of one piece with the notch.

22. The knife defined in claim 18, further comprising a rocker forming the notch, movable longitudinally on the button, and having adjacent the notch a surface engageable longitudinally with the pawl in the actuated position of the button on movement of the guard from the retracted to the extended position; and a rocker spring urging the rocker toward the pawl and weaker than the guard spring.

23. The knife defined in claim 22 wherein the rocker is pivotal on the button.

24. The knife defined in claim 22 wherein the arm has an outer end engageable in the notch and with the surface of the rocker and the one formation between the arm outer end and the transverse pawl axis.

25. The knife defined in claim 22 wherein the rocker spring is braced longitudinally between the rocker and the button.

26. The knife defined in claim 13 wherein the guide forms the formation.

27. The knife defined in claim 13 wherein the parts of the guard symmetrically flank the blade plane.

28. The knife defined in claim 13 wherein the guard is formed by a wire having a pair of loops forming the parts.

* * * * *